US007086716B2

(12) United States Patent
Steinfield et al.

(10) Patent No.: US 7,086,716 B2
(45) Date of Patent: Aug. 8, 2006

(54) FLUID-EJECTION ASSEMBLY

(75) Inventors: Steve Steinfield, San Diego, CA (US); Scott Hock, Poway, CA (US); Myron A. Bezenek, San Marcos, CA (US); Victor T. Escobedo, Bonita, CA (US); Kenneth J. Courian, San Diego, CA (US); Mohammad M. Samii, La Jolla, CA (US); Juan C. Vives, San Diego, CA (US); Antoni Murcia, San Diego, CA (US); David Berardelli, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 209 days.

(21) Appl. No.: 10/693,777

(22) Filed: Oct. 25, 2003

(65) Prior Publication Data

US 2005/0088479 A1 Apr. 28, 2005

(51) Int. Cl.
*B41J 2/165* (2006.01)

(52) U.S. Cl. ..... 347/32; 347/29; 347/39; 347/33; 347/35

(58) Field of Classification Search ..... 347/8, 347/22–24, 28–30, 33, 37, 43, 49, 54; 400/82, 400/171, 159
See application file for complete search history.

(56) References Cited

U.S. PATENT DOCUMENTS

| | | | | |
|---|---|---|---|---|
| 5,398,053 | A | 3/1995 | Hirosawa et al. | |
| 5,587,730 | A | 12/1996 | Karz | |
| 5,838,343 | A | 11/1998 | Chapin et al. | |
| 5,984,455 | A | 11/1999 | Anderson | |
| 6,076,910 | A | 6/2000 | Anderson | |
| 6,244,688 | B1 | 6/2001 | Hickman | |
| 6,364,451 | B1 | 4/2002 | Silverbrook | |
| 6,467,887 | B1 | 10/2002 | Lopez et al. | |
| 6,536,883 | B1 | 3/2003 | Hawkins et al. | |
| 6,783,209 | B1 * | 8/2004 | Gompertz | 347/43 |
| 2002/0163549 | A1 | 11/2002 | Anderson et al. | |

FOREIGN PATENT DOCUMENTS

| | | | |
|---|---|---|---|
| JP | 2000218884 | | 8/2000 |
| JP | 2002-059559 | * | 2/2002 |
| JP | 2002059559 | | 2/2002 |
| WO | WO/03074277 | | 9/2003 |

* cited by examiner

OTHER PUBLICATIONS

European Search Report dated Feb. 16, 2005. DeGroot, R, Ep 04 25 5774.

*Primary Examiner*—Shih-Wen Hsieh

(57) ABSTRACT

A fluid-ejection assembly of one embodiment is disclosed comprising first and second arrays of fluid-ejection mechanisms, first and second service stations, and first and second drive mechanisms. The first array ejects fluid onto media; the first service station is to service the first array. The second array ejects fluid onto the media; the second service station is to service the second array. The first drive mechanism moves the first array between a first position to eject fluid onto the media and a second position at the first service station, while the second array ejects fluid onto the media in place of the first array. The second drive mechanism moves the second array between a third position to eject fluid onto the media and a fourth position at the second service station while the first array ejects fluid onto the media in place of the second array.

27 Claims, 4 Drawing Sheets

FLUID-EJECTION ASSEMBLY

BACKGROUND

Inkjet printers generally operate by ejecting ink onto media, such as paper. One type of inkjet printer utilizes an array of inkjet printheads to eject ink onto media. The inkjet printheads within the array are normally immobile relative to each other, and are typically arranged either in-line along the direction of printing or in a staggered fashion relative to each other. As media is moved past the array of inkjet printheads, the printheads accordingly eject ink onto the media. This type of inkjet printer is typically used in industrial setting.

Printing is interrupted when any of the printheads within the array need servicing. Servicing is generally defined as tasks performed to maintain a printhead in proper operating condition such as wiping debris from the printhead, ejecting ink from the printhead, and capping the printhead when not in use. Replacing a printhead that has permanently failed with a properly operating printhead also falls under the general definition of servicing. Unfortunately, interrupting printing to service the array of inkjet printheads delays completion of a print job and can waste significant amounts of ink and media.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the invention. The following detailed description is, therefore, not to be taken in a limiting sense, and the scope of the invention is defined only by the appended claims.

Fluid-ejection Assembly

Figure 1:
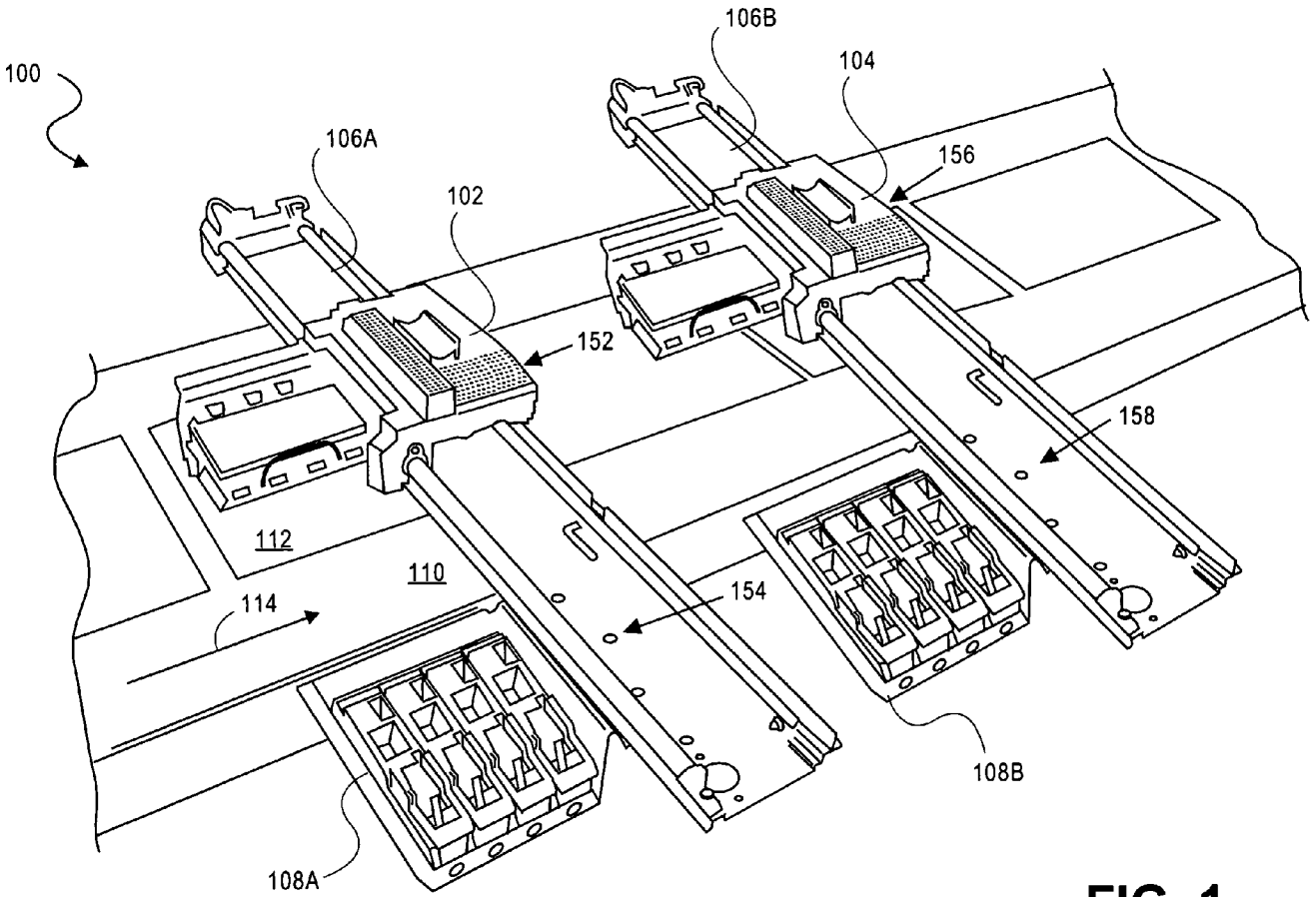
FIG. 1 is a perspective view of a fluid-ejection assembly, according to an embodiment of the invention.

FIG. 1 shows a fluid-ejection assembly 100, according to an embodiment of the invention. The fluid-ejection assembly 100 includes a first array of fluid-ejection mechanisms 102, a first drive mechanism 106A, a first service station 108A, a second array of fluid-ejection mechanisms 104, a second drive mechanism 106B, and a second service station 108B. The drive mechanisms 106A and 106B are collectively referred to as the drive mechanisms 106, and the service stations 108A and 108B are collectively referred to as the service stations 108. The fluid-ejection assembly 100 can also include a moveable media belt 110, on which media 112 is moved for fluid ejection thereon by the first array 102 or the second array 104.

The arrays 102 and 104 can in one embodiment be arrays of inkjet printheads, such that the assembly 100 is an inkjet assembly. The fluid-ejection assembly 100 preferably is a drop-on-demand fluid-ejection assembly, as opposed to a continuous fluid-ejection assembly commonly referred to as continuous inkjet (CIJ). A drop-on-demand assembly ejects ink as it is to be used to form an image on the media 112, whereas a continuous inkjet assembly continuously ejects ink. The continuously ejected ink is deflected to either impact the media 112 or be directed away from the media 112, in accordance with the image to be formed on the media 112. Drop-on-demand fluid-ejection assemblies include thermal inkjet (TIJ) and piezo inkjet (PIJ) technologies. TIJ technology generally utilizes heat to eject ink, whereas PIJ technology generally utilizes pressure to eject ink.

The first array 102 is connected with the first drive mechanism 106A. The first drive mechanism 106A is moved relative to the first service station 108A and a movable media belt 110 such that the first drive mechanism 106A can move the first array 102 between a first position 152 and a second position 154. In the first position 152, the first array 102 is able to eject fluid onto media 112 traversing in a direction indicated by the arrow 114 on the movable media belt 110, while the array 102 remains stationary, such that the array 102 can be referred to as being normally stationary. The first array 102 is thus positioned over the belt 110 in the first position 152 for fluid ejection, such that the belt 110 moves, with the media 112 thereon, past the first array 102. In the second position 154, the first array 102 is at the first service station 108A, for servicing the first array 102.

The second array 104 is connected with the second drive mechanism 106B. The second drive mechanism 106B is moved relative to the second service station 108B and the movable media belt 110 such that the second drive mechanism 106B can move the second array 104 between and a third position 156 and a fourth position 158. In the third position 156, the second array 104 is able to eject fluid onto the media 112 traversing in a direction indicated by the arrow 114 on the movable media belt 110, while the array 104 remains stationary, such that the array 104 can be referred to as being normally stationary. The second array 104 is thus positioned over the belt 110 in the third position 156 for fluid ejection, such that the belt 110 moves, with the media 112 thereon, past the second array 104. In the fourth position 158, the second array 104 is at the second service station 108B, for servicing the second array 104.

Thus, when the array of fluid-ejection mechanisms 102 is to be serviced, the array 102 moves via the drive mechanism 106A so that it is positioned at the first service station 108A. Similarly, when the array of fluid-ejection mechanisms 104 is to be serviced, the array 104 moves via the drive mechanism 106B so that it is positioned at the second service station 108B. When the array 102 is ejecting fluid on the media 112 moving on the belt 110, the array 104 is not ejecting fluid on the media 112. Similarly, when the array 104 is ejecting fluid on the media 112 moving on the belt 110, the array 102 is not ejecting fluid on the media 112.

As a result, fluid ejection may continue onto the media 112 without having to stop movement of the media 112 when either of the arrays 102 and 104 has to be serviced. The media 112, as being moved on the belt 110, does not have become aware that the array 104 has substituted for the array 102, and vice-versa. That is, the media 112 does not have to slow down when either of the arrays 102 and 104 is serviced. When the array 102 is to be serviced, the array 104 is first moved to the third position 156, so that it can begin ejecting fluid onto the media 112 before the array 102 stops ejecting fluid and is moved to the service station 108A. Similarly, when the array 104 is to be serviced, the array 102 is first moved to the first position 152, so that it can begin ejecting fluid onto the media before the array 104 stops ejecting fluid and is moved to the service station 108B. The array 104 thus ejects fluid in place of the array 102 while the array 102 is being serviced, and the array 102 ejects fluid in place of the array 104 while the array 104 is being serviced.

The drive mechanisms 106 include those components, such as motors, rails, and so on, which enable the arrays 102 and 104 to be moved. In one embodiment of the invention, the drive mechanisms 106A and 106B are automatic linear-actuators. Alternatively, the drive mechanisms 106A and 106B are manually operated bearing rails. The stations 108 include those components, such as wipers, and so on, those enable the arrays 102 and 104 to be serviced either manually or automatically. The media 112 can be cut-sheet paper. Alternatively, the media 112 can be continuous web paper, corrugated boxes, labels, and the like, or another type of media.

The fluid-ejection assembly 100 is pictured in FIG. 1 and has been described as having a first array of fluid-ejection mechanisms 102 and a second array of fluid-ejecting mechanisms 104. Alternatively, there can be more than two arrays of fluid-ejecting mechanisms. Having more than two arrays means that when any one array of fluid-ejection mechanisms is to be serviced, more than one array remains to take over fluid-ejection responsibilities.

Figure 2:
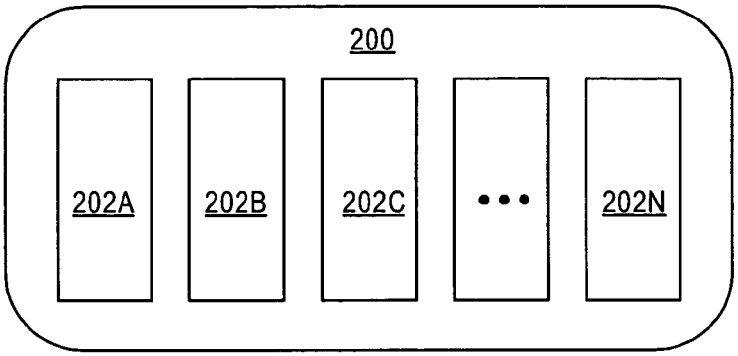
FIG. 2 is a schematic diagram of an array of fluid-ejection mechanisms, according to an embodiment of the invention.

FIG. 2 shows an array of fluid-ejection mechanisms 200, according to an embodiment of the invention. The array 200 may implement either or both of the first array of fluid-ejection mechanisms 102 and the second array of fluid-ejection mechanisms 104 of FIG. 1. The array 200 includes fluid-ejection mechanisms 202A, 202B, 202C, . . . , 202N, where N is the total number of the fluid-ejection mechanisms 202. The fluid-ejection mechanisms 202 are aligned such that they are in-line with respect to one another. In one embodiment of the invention, N=4 and the fluid-ejection mechanisms 202 all eject black ink. In another embodiment of the invention, N=4 and the fluid-ejection mechanisms 202 eject different spot color inks, such as red, blue, purple, orange, and the like. In another embodiment of the invention, N=4 and the fluid-ejection mechanism 202 eject differently colored inks in accordance with a color model, such as the cyan-magenta-yellow-black (CMYK) color model. The number of the mechanisms 202 may also be other than four.

Figure 3:
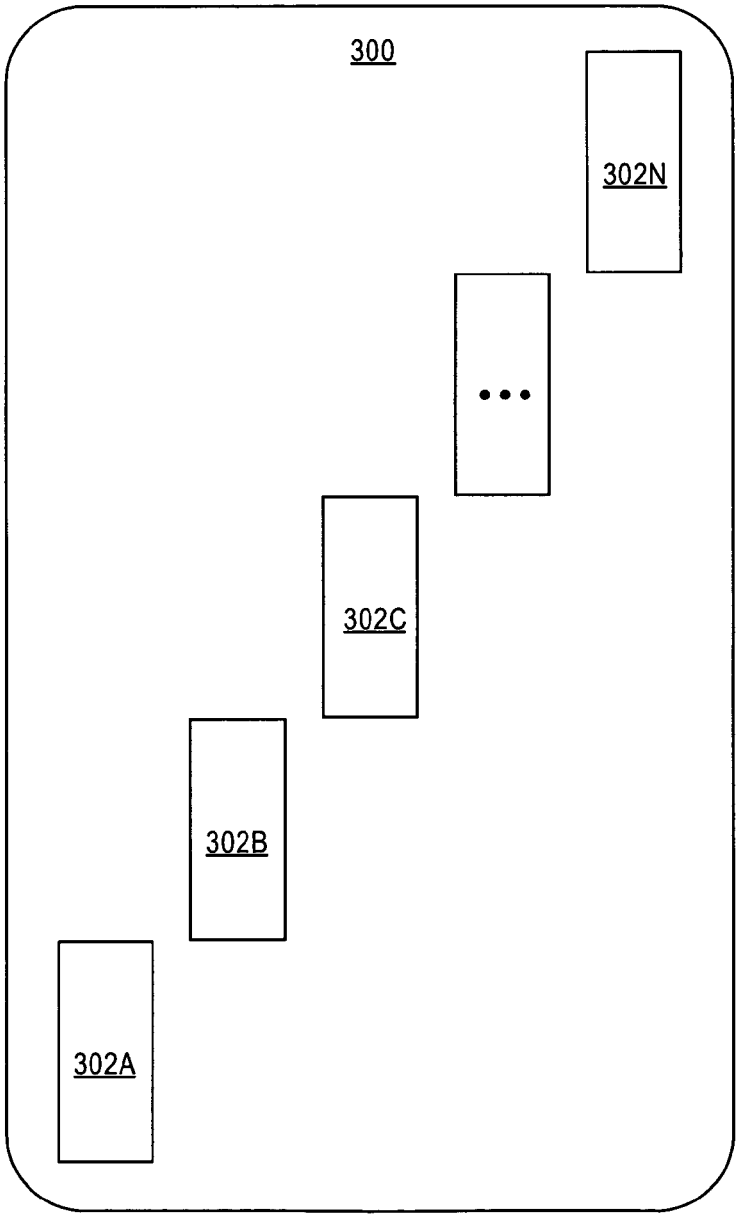
FIG. 3 is a schematic diagram of an array of fluid-ejection mechanisms, according to another embodiment of the invention.

FIG. 3 shows an array of fluid-ejection mechanisms 300, according to another embodiment of the invention. The array 300 may implement either or both of the first array of fluid-ejection mechanisms 102 and the second array of fluid-ejection mechanisms 104 of FIG. 1. The array 300 includes fluid-ejection mechanisms 302A, 302B, 302C, . . . , 302N, where N is the total number of fluid-ejection mechanisms. The fluid-ejection mechanisms 302 are aligned such that they are staggered relative to each other. In one embodiment of the invention, N=5 and the fluid-ejection mechanisms 302 are all inkjet printheads ejecting black ink. In another embodiment of the invention, N=5 and the fluid-ejection mechanisms 302 are all inkjet printheads ejecting different spot color inks. The number of the mechanisms 302 may also be other than five.

Method

Figure 4:
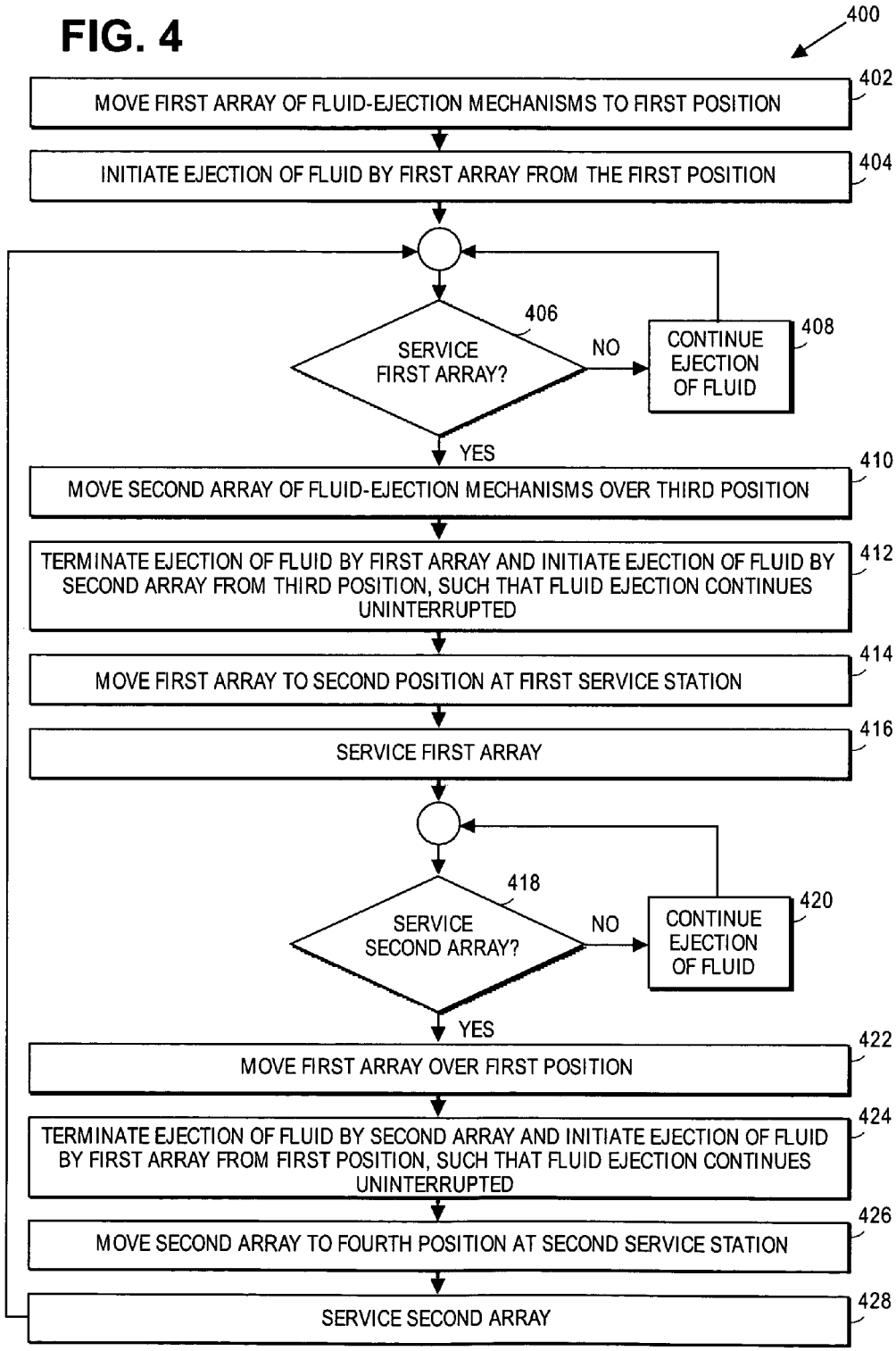
FIG. 4 is a flowchart describing a method for operating the fluid-ejection assembly of FIG. 1, according to an embodiment of the invention.

FIG. 4 is a flowchart describing a method 400 for operating the fluid-ejection assembly of FIG. 1, according to an embodiment of the invention. The method 400 may be implemented as a computer program on a computer-readable medium. The computer-readable medium may be a volatile or a non-volatile medium. The medium may also be a magnetic medium, like a floppy disk or a hard disk drive, an optical medium, like a compact disc (CD)-type medium or a digital versatile disc (DVD)-type medium, and/or a semiconductor medium, like a flash memory or a dynamic random access memory (DRAM).

The method 400 begins when the first array of fluid-ejection mechanisms 102 is moved in the first position 152 (402), such as by the first drive mechanism 106A. The first array 102 then initiates ejection of fluid onto the media 112 from the first position 152 (404). Where the first array 102 does is not to be serviced (406), then the first array 102 continues to eject fluid (408).

Once the first array 102 is to be serviced (406), however, the second array of fluid-ejection mechanisms 104 is moved in the third position 156 (410), such as by the second drive mechanism 106B. Ejection of fluid from the first array 102 is terminated, and ejection of fluid from the second array 104 is initiated from the third position 156 (412). The first array 102 is moved to the second position 154 at the first service station 108A (414), such as by the first drive mechanism 106A, and the first array 102 is serviced (416).

Where the second array 104 does is not to be serviced (418), then the second array 104 continues to eject fluid (420). Once the second array 104 is to be serviced (418), however, the first array 102 is moved back in the first position 152 (422), such as by the first drive mechanism 106A. Ejection of fluid from the second array 104 is terminated, and ejection of fluid from the first array 104 is again initiated from the first position 152 (424). The second array 104 is moved to the fourth position 158 at the second service station 108B (426), such as by the second drive mechanism 106B, and the second array 104 is serviced (428). The method 400 then repeats at 406 as has been described, until the fluid-ejection, or print, job is finished.

It is noted that in one embodiment of the invention, servicing is manually triggered by an operator. An operator may, for instance, trigger servicing upon determining that an array of fluid ejection mechanisms is not properly ejecting fluid onto media 112. In another embodiment of the invention, servicing is automatically triggered, via, for instance, machine-vision inspection detecting that an array of fluid ejection mechanisms is not properly ejecting fluid onto media 112. Alternatively, servicing may be automatically triggered at predetermined intervals.

Fluid-ejection Device and Conclusion

Figure 5:
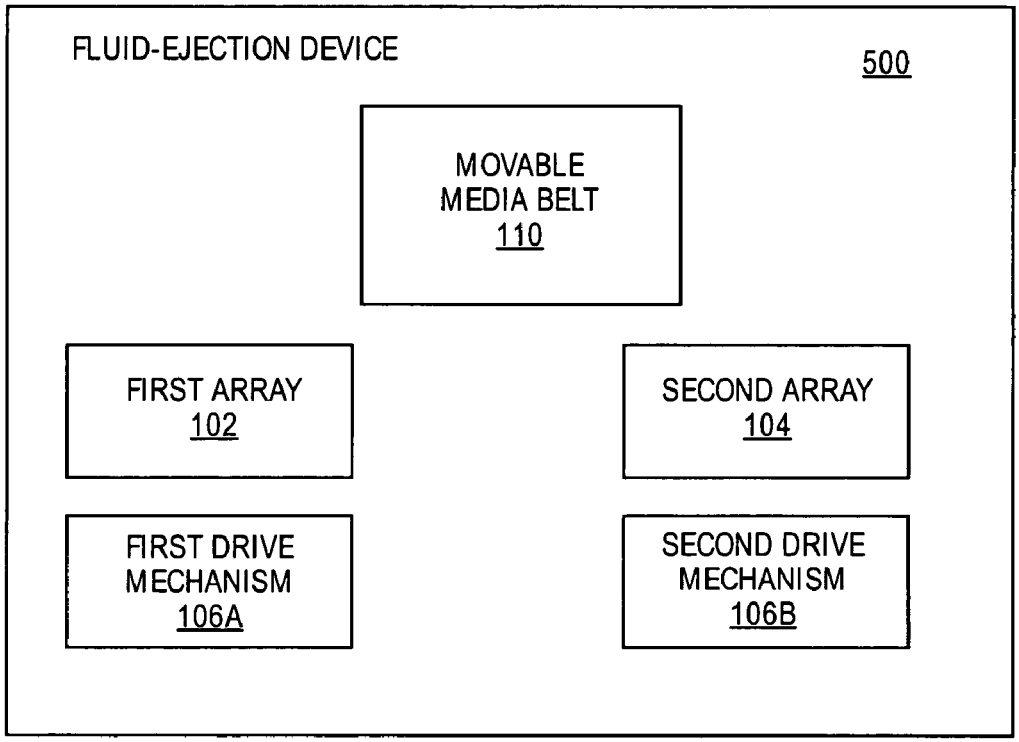
FIG. 5 is a block diagram of a fluid-ejection device, according to an embodiment of the invention.

FIG. 5 shows a block diagram of a fluid-ejection device 500, according to an embodiment of the invention. The fluid-ejection device 500 includes the belt 110 on which media moves, as has been described. The fluid-ejection device 500 also includes the array of fluid-ejection mechanisms 102, and the array of fluid-ejection mechanisms 104, as have also been described. Finally, the fluid-ejection device 500 includes the drive mechanisms 106, as have been described. The device 500 may include other components, in addition to and/or in lieu of those depicted in FIG. 5, such as, for example, the service stations 108 of FIG. 1.

The fluid-ejection device 500 is operable as has been described in the preceding sections of the detailed description. For instance, where the array 102 is ejecting fluid, the array 104 is not, and vice-versa. Where the arrays 102 and 104 are arrays of inkjet-printing mechanisms, such as inkjet printheads or pens, the fluid-ejection device 500 is specifically an inkjet-printing device, such as an inkjet printer.

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of the invention. Therefore, it is manifestly intended that this invention be limited only by the claims and equivalents thereof.

We claim:

1. A fluid-ejection assembly comprising:

a first array of fluid-ejection mechanisms;

a first service station;

a second array of fluid-ejection mechanisms;

a second service station;

a first drive mechanism to move the first array of fluid-ejection mechanisms between a first position and a second position at the first service station to allow the second array of fluid-ejection mechanisms to continue to eject the fluid onto media at a third position without stopping movement of the media and with the first array of fluid-ejection mechanisms at the second position; and, a second drive mechanism to move the second array of fluid-ejection mechanisms between the third position and a fourth position at the second service station to allow the first array of fluid-ejection mechanisms to continue to eject the fluid onto the media at the first position without stopping movement of the media and with the second array of fluid-ejection mechanisms at the fourth position.

2. The assembly of claim 1, wherein each of the first array of fluid-ejection mechanisms and the second array of fluid-ejection mechanisms remains stationary while ejecting fluid onto the media, such that the media moves past one of the first and the second arrays of fluid-ejection mechanisms.

3. The assembly of claim 2, further comprising a belt on which the media is moved past one of the first and the second arrays of fluid-ejection mechanisms.

4. The assembly of claim 1, wherein while the first array of fluid-ejection mechanisms is to be serviced at the first service station in the second position, the second array of fluid-ejection mechanisms is to eject fluid onto the media in the third position.

5. The assembly of claim 1, wherein while the second array of fluid-ejection mechanisms is to be serviced at the second service in the fourth position, the first array of fluid-ejection mechanisms is to eject fluid onto the media in the first position.

6. The assembly of claim 1, wherein the first array of fluid-ejection mechanisms and the second array of fluid-ejection mechanisms each comprises an array of inkjet printheads for ejecting ink onto the media.

7. The assembly of claim 1, wherein the first array of fluid-ejection mechanisms and the second array of fluid-ejection mechanisms each eject different spot color inks.

8. The assembly of claim 1, wherein the first array of fluid-ejection mechanisms and the second array of fluid-ejection mechanisms each eject differently colored inks in accordance with a color model.

9. The assembly of claim 8, wherein the color model is a cyan-magenta-yellow-black (CMYK) color model.

10. A fluid-ejection assembly comprising:

a first array of fluid-ejection mechanisms to eject fluid onto media;

a first service station to service the first array of fluid-ejection mechanisms;

a first drive mechanism to move the first array of fluid-ejection mechanisms between a first position to eject fluid onto the media and a second position at the first service station; and, means for ejecting fluid onto the media, while the first array of fluid-ejection mechanisms is at the first service station in the second position for servicing to allow fluid ejection onto the media to continue uninterrupted.

11. The assembly of claim 10, wherein the means comprises a second array of fluid-ejection mechanisms, and a second drive mechanism for the second array of fluid-ejection mechanisms.

12. The assembly of claim 11, wherein the means further comprises a second service station for the second array of fluid-ejection mechanisms.

13. The assembly of claim 10, further comprising a belt on which media is moved, such that the first array of fluid-ejection mechanisms remains stationary over the belt while ejecting fluid onto the media.

14. The assembly of claim 10, wherein the first array of fluid-ejection mechanisms comprises an array of inkjet printheads for ejecting ink onto the media.

15. A fluid-ejection device comprising:

a belt on which media is moved;

a first array of fluid-ejection mechanisms movable by a first drive mechanism between a first position at which the first array ejects fluid onto the media while remaining stationary, and a second position at which the first array is serviced at a first service station; and, a second array of fluid-ejection mechanisms movable by a second drive mechanism between a third position at which the second array ejects fluid onto the media while remaining stationary, and a fourth position at which the second array is serviced at a second service station, wherein the first array ejects fluid onto the media while the second array is being serviced, and the second array ejects fluid onto the media while the first array is being serviced to allow ejection of the fluid onto the media to continue uninterrupted.

16. The device of claim 15, further comprising the first drive mechanism and the second drive mechanism.

17. The device of claim 15, further comprising the first service station and the second service station.

18. The device of claim 15, wherein the first array of fluid-ejection mechanisms and the second array of fluid-ejection mechanisms each comprises an array of inkjet printheads for ejecting ink onto the media.

19. A fluid-ejection device comprising:

a belt on which media is moved;

first means for ejecting fluid onto the media as the media is moved;

second means for ejecting fluid onto the media as the media is moved while the first means is being serviced so that fluid ejection continues onto the media without stopping movement of the media.

20. The device of claim 19, wherein the first means is for ejecting fluid onto the media as the media is moved while the second means is being service so that fluid ejection continues onto the media without stopping movement of the media.

21. The device of claim 19, wherein the fluid ejected onto the media is ink, such that the fluid-ejection device is an inkjet-printing device.

22. A method for ejecting comprising:

moving a first array of fluid-ejection mechanisms to a first position for ejecting fluid onto media, the first array movable between a first position and a second position;

ejecting fluid onto the media by the first array of fluid-ejection mechanisms from the first position;

moving a second array of fluid-ejection mechanisms to a third position for ejecting fluid onto the media;

stopping ejection of fluid by the first array of fluid-ejection mechanisms and ejecting fluid onto the media by the second array of fluid-ejection mechanisms from the third position such that fluid ejection onto the media continues uninterrupted;

moving the first array of fluid-ejection mechanisms to the second position for servicing; and, servicing the first array of fluid-ejection mechanisms at the second position.

23. The method of claim 22, further comprising:

moving the first array of fluid-ejection mechanisms back to the first position for ejecting fluid onto the media;

stopping ejecting of fluid by the second array of fluid-ejection mechanisms and ejecting fluid onto the media by the first array of fluid-ejection mechanisms from the first position such that fluid ejection onto the media continues interrupted;

moving the second array of fluid-ejection mechanisms to a fourth position for servicing; and, servicing the second array of fluid-ejection mechanisms at the fourth position.

24. The method of claim 23, wherein servicing the first array of fluid-ejection mechanisms at the second position comprises servicing the first array of fluid-ejection mechanisms at a first service station at the second position.

25. The method of claim 24, wherein servicing the second array of fluid-ejection mechanisms at the fourth position comprises servicing the second array of fluid-ejection mechanisms at a second service station at the fourth position.

26. The method of claim 22, wherein moving the first array of fluid-ejection mechanisms to the first position comprises moving the first array of fluid-ejection mechanisms to the first position by a first drive mechanism.

27. The method of claim 26, wherein moving the second array of fluid-ejection mechanisms to the third position comprises moving the second array of fluid-ejection mechanisms to the third position by a second drive mechanism.

* * * * *

UNITED STATES PATENT AND TRADEMARK OFFICE

CERTIFICATE OF CORRECTION

PATENT NO. : 7,086,716 B2
APPLICATION NO. : 10/693777
DATED : August 8, 2006
INVENTOR(S) : Steve Steinfield et al.

It is certified that error appears in the above-identified patent and that said Letters Patent is hereby corrected as shown below:

In column 6, line 16, in Claim 10, delete “media,” and insert -- media --, therefor.

Signed and Sealed this

Tenth Day of February, 2009

John Doll

JOHN DOLL
*Acting Director of the United States Patent and Trademark Office*